US011000170B2

(12) United States Patent
Blumhardt et al.

(10) Patent No.: US 11,000,170 B2
(45) Date of Patent: May 11, 2021

(54) FLOOR CLEANING SYSTEM

(71) Applicant: ALFRED KARCHER SE & CO. KG, Winnenden (DE)

(72) Inventors: Heiko Blumhardt, Remseck (DE); Barbara Pfister, Weissach im Tal (DE); Frank Nonnenmann, Schorndorf (DE); Patrick Prasser, Essen (DE); Christoph Waller, Schwaikheim (DE)

(73) Assignee: ALFRED KÄRCHER SE & CO. KG, Winnenden (DE)

( * ) Notice: Subject to any disclaimer, the term of this patent is extended or adjusted under 35 U.S.C. 154(b) by 366 days.

(21) Appl. No.: 16/178,909

(22) Filed: Nov. 2, 2018

(65) Prior Publication Data

US 2019/0069748 A1 Mar. 7, 2019

Related U.S. Application Data

(63) Continuation of application No. PCT/EP2016/060077, filed on May 4, 2016.

(51) Int. Cl.

| | |
|---|---|
| ***A47L 11/30*** | (2006.01) |
| ***A47L 11/40*** | (2006.01) |
| ***A47L 11/14*** | (2006.01) |

(52) U.S. Cl.

CPC ..... *A47L 11/302* (2013.01); *A47L 11/145* (2013.01); *A47L 11/4011* (2013.01); (Continued)

(58) Field of Classification Search

CPC .. A47L 11/302; A47L 11/4013; A47L 11/145; A47L 11/4011; A47L 11/4019; (Continued)

(56) References Cited

U.S. PATENT DOCUMENTS 5,572,759 A 11/1996 Zachhuber
5,959,423 A 9/1999 Nakanishi et al.
(Continued)

FOREIGN PATENT DOCUMENTS

CN 1551740 12/2004
CN 1665438 9/2005
(Continued)

OTHER PUBLICATIONS

Official Action (with English translation) for Chinese Patent Application No. 201680084638.5, dated Jun. 30, 2020, 10 pages.
(Continued)

*Primary Examiner* — David Redding
(74) *Attorney, Agent, or Firm* — Sheridan Ross P.C.

(57) ABSTRACT

The invention relates to a floor cleaning system, having a mobile floor cleaning apparatus that comprises at least one cleaning unit for cleaning a floor surface, a reservoir for receiving a cleaning liquid, a dirt receiving device for taking up dirty liquid from the floor surface, and a dirty liquid container into which the dirty liquid is transferable; and further having a docking station for the floor cleaning apparatus, which is docked thereto in a docked position; wherein the docking station has at least one supply conduit with a connection element arranged thereon, the floor cleaning apparatus having at least one liquid conduit with a connection element arranged thereon; wherein the floor cleaning apparatus comprises a rinsing device on or in the dirty liquid container; and wherein, when the floor cleaning apparatus is in the docked position, the connection elements are coupled to one another such that the reservoir is fillable with the cleaning liquid via the at least one liquid conduit and a rinsing liquid for rinsing the dirty liquid container is applicable to the rinsing device via the at least one liquid conduit.

27 Claims, 5 Drawing Sheets

(52) U.S. Cl.
CPC ..... *A47L 11/4013* (2013.01); *A47L 11/4019* (2013.01); *A47L 11/4025* (2013.01); *A47L 11/4083* (2013.01); *A47L 2201/02* (2013.01); *A47L 2201/022* (2013.01); *A47L 2201/024* (2013.01); *A47L 2201/026* (2013.01)

(58) Field of Classification Search
CPC ..... A47L 11/4025; A47L 11/4083; A47L 2201/02; A47L 2201/022; A47L 2201/024; A47L 2201/026; A47L 11/4016
See application file for complete search history.

(56) References Cited

U.S. PATENT DOCUMENTS

| | | | |
|---|---|---|---|
| 7,891,387 | B2 | 2/2011 | Lim et al. |
| 8,776,305 | B2 | 7/2014 | Troff et al. |
| 9,687,131 | B2 | 6/2017 | Eidmohammadi et al. |

FOREIGN PATENT DOCUMENTS

| | | |
|---|---|---|
| CN | 101057767 | 10/2007 |
| CN | 101254080 | 9/2008 |
| CN | 201572039 | 9/2010 |
| CN | 102357480 | 2/2012 |
| CN | 103200852 | 7/2013 |
| CN | 104010485 | 8/2014 |
| CN | 204860064 | 12/2015 |
| CN | 106470584 | 3/2017 |
| DE | 4230197 | 3/1994 |
| DE | 102005045669 | 3/2007 |
| DE | 102010038422 | 1/2012 |
| DE | 102014105460 | 10/2015 |
| EP | 1762165 | 3/2007 |
| EP | 2648307 | 10/2013 |
| KR | 10-2014-0036653 | 5/2014 |
| WO | WO 94/05197 | 3/1994 |
| WO | WO 2005/104921 | 11/2005 |
| WO | WO 2015/082017 | 6/2015 |

OTHER PUBLICATIONS

Translated International Preliminary Report on Patentability for International (PCT) Patent Application No. PCT/EP2016/060060, dated Nov. 15, 2018, 9 pages.
Translated International Preliminary Report on Patentability for International (PCT) Patent Application No. PCT/EP2017/059347, dated Nov. 15, 2018, 8 pages.
Translated International Preliminary Report on Patentability for International (PCT) Patent Application No. PCT/EP2016/060077, dated Nov. 15, 2018, 8 pages.
Translated International Preliminary Report on Patentability for International (PCT) Patent Application No. PCT/EP2016/060092, dated Nov. 15, 2018, 9 pages.
Official Action (with English translation) for Chinese Patent Application No. 201780023750.2, dated Jun. 4, 2020, 23 pages.
Official Action (with English translation) for Chinese Patent Application No. 201680084615.4, dated Jun. 3, 2020. 15 pages.
U.S. Appl. No. 16/178,836, filed Nov. 2, 2018, Juettner et al.
U.S. Appl. No. 16/178,859, filed Nov. 2, 2018, Juettner et al.
U.S. Appl. No. 16/178,933, filed Nov. 2, 2018, Wurm et al.
International Search Report for International (PCT) Patent Application No. PCT/EP2016/060060, dated Jan. 10, 2017, 2 pages.
International Search Report for International (PCT) Patent Application No. PCT/EP2017/059347, dated Jul. 25, 2017, 2 pages.
International Search Report for International (PCT) Patent Application No. PCT/EP2016/060077, dated Jan. 13, 2017, 2 pages.
International Search Report for International (PCT) Patent Application No. PCT/EP2016/060092, dated Jan. 17, 2017, 2 pages.
Official Action (with English translation) for Chinese Patent Application No. 201680084626.2, dated Jun. 17, 2020, 13 pages.

FLOOR CLEANING SYSTEM

CROSS-REFERENCE TO RELATED APPLICATIONS

This application is a continuation application under 35 U.S.C. 111(a) of international application number PCT/EP2016/060077, filed on May 4, 2016, the entire disclosure of which is hereby incorporated by reference.

FIELD OF THE INVENTION

The present invention relates to a floor cleaning system, having a mobile floor cleaning apparatus that comprises at least one cleaning unit for cleaning a floor surface, a reservoir for receiving a cleaning liquid, a dirt receiving device for taking up dirty liquid from the floor surface, and a dirty liquid container into which the dirty liquid is transferable.

BACKGROUND OF THE INVENTION

With a floor cleaning apparatus of the aforementioned kind, the floor surface may be cleaned using at least one cleaning unit. The cleaning unit comprises for example a roller-shaped or plate-shaped cleaning tool that is drivable in rotation. For enhancing the cleaning effect, a cleaning liquid, usually water, from the reservoir may be applied to the floor surface. As a supplementary measure, a chemical cleaning agent may be added to the water. The mixture of dirt and cleaning liquid—the dirty liquid—may be taken up from the floor surface by the dirt receiving device and transferred to the dirty liquid container. The dirt receiving device has for example a suction bar and a suction unit that applies negative pressure thereto.

The mobile floor cleaning apparatus may be configured to be self-propelling and self-steering in order to enable autonomous cleaning of the floor surface. The floor cleaning apparatus is thus in particular a cleaning robot.

As an alternative or in addition, the floor cleaning apparatus may be guided manually. An operator may guide the floor cleaning apparatus over the floor surface. Optionally, the floor cleaning apparatus may be provided with a drive for a travelling gear.

An object underlying the present invention is to provide a floor cleaning system that is more user-friendly.

SUMMARY OF THE INVENTION

In an aspect of the invention, a floor cleaning system has a mobile floor cleaning apparatus that comprises at least one cleaning unit for cleaning a floor surface, a reservoir for receiving a cleaning liquid, a dirt receiving device for taking up dirty liquid from the floor surface, and a dirty liquid container into which the dirty liquid is transferable, and further comprises a docking station for the floor cleaning apparatus, which is docked thereto in a docked position. The docking station has at least one supply conduit with a connection element arranged thereon, and the floor cleaning apparatus has at least one liquid conduit with a connection element arranged thereon. The floor cleaning apparatus comprises a rinsing device on or in the dirty liquid container, and when the floor cleaning apparatus is in the docked position, the connection elements are coupled to one another such that the reservoir is fillable with the cleaning liquid via the at least one liquid conduit and a rinsing liquid for rinsing the dirty liquid container is applicable to the rinsing device via the at least one liquid conduit.

BRIEF DESCRIPTION OF THE DRAWINGS

The foregoing summary and the following description may be better understood in conjunction with the drawing figures, of which.

DETAILED DESCRIPTION OF PREFERRED EMBODIMENTS OF THE INVENTION

Figure 1:
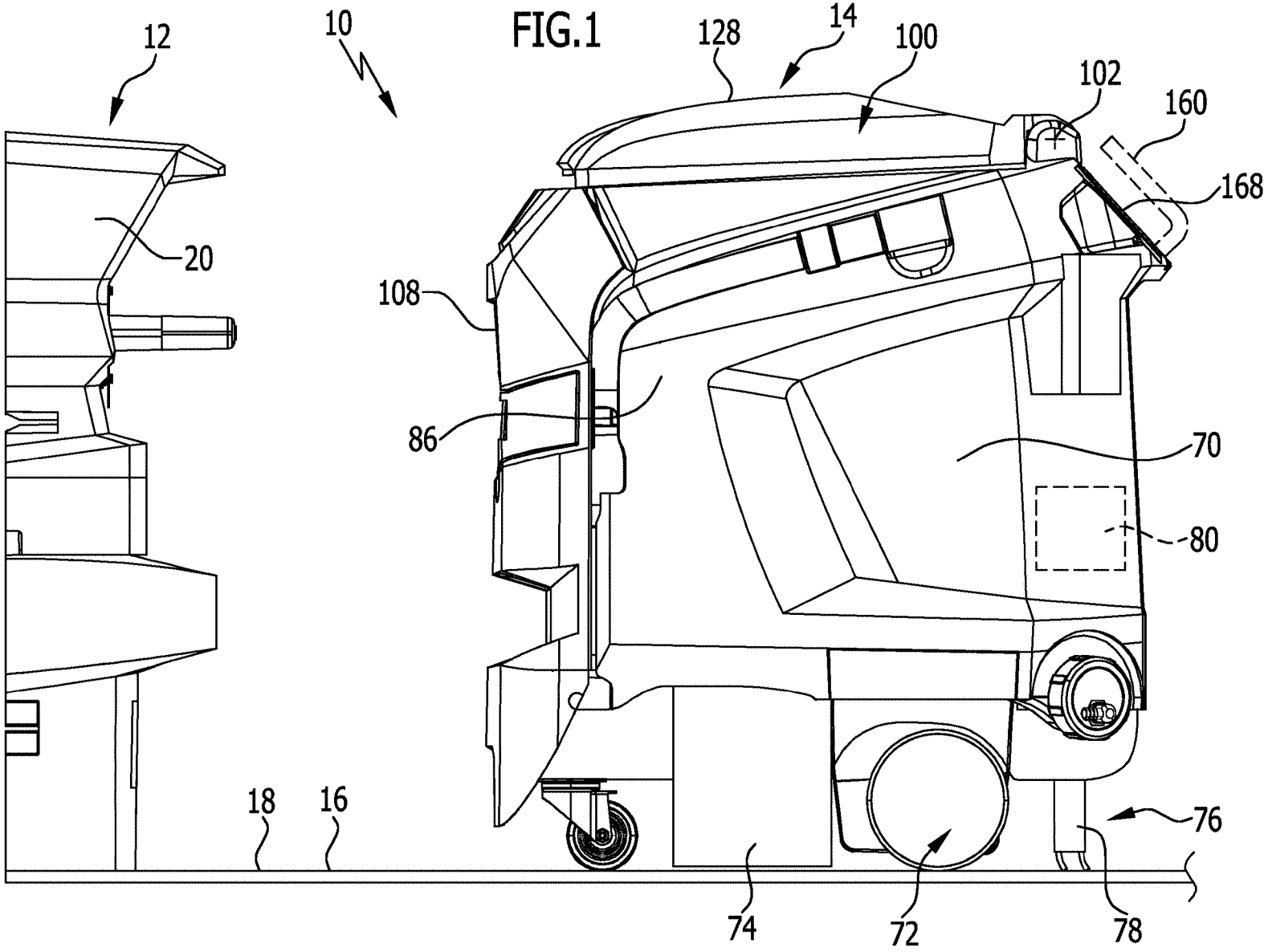
FIG. 1 shows a side view of a floor cleaning system in accordance with the invention, comprising a floor cleaning apparatus and a docking station therefor, wherein the floor cleaning apparatus is not docked to the docking station.

Although the invention is illustrated and described herein with reference to specific embodiments, the invention is not intended to be limited to the details shown. Rather, various modifications may be made in the details within the scope and range of equivalents of the claims and without departing from the invention.

The present invention relates to a floor cleaning system, having a mobile floor cleaning apparatus that comprises at least one cleaning unit for cleaning a floor surface, a reservoir for receiving a cleaning liquid, a dirt receiving device for taking up dirty liquid from the floor surface, and a dirty liquid container into which the dirty liquid is transferable. The floor cleaning system further comprises a docking station for the floor cleaning apparatus, which is docked thereto in a docked position. The docking station has at least one supply conduit with a connection element arranged thereon, and the floor cleaning apparatus has at least one liquid conduit with a connection element arranged thereon. The floor cleaning apparatus comprises a rinsing device on or in the dirty liquid container. When the floor cleaning apparatus is in the docked position, the connection elements are coupled to one another such that the reservoir is fillable with the cleaning liquid via the at least one liquid conduit and a rinsing liquid for rinsing the dirty liquid container is applicable to the rinsing device via the at least one liquid conduit.

In addition to the floor cleaning apparatus, the floor cleaning system in accordance with the invention has a docking station. When the floor cleaning apparatus is in a docked position, corresponding connection elements of the at least one supply conduit and the at least one liquid conduit may be coupled to one another. This provides the possibility of filling the reservoir with the cleaning liquid and rinsing the dirty liquid container with a rinsing liquid by way of the rinsing device of the floor cleaning apparatus. There is no need for a user to fill the reservoir with the cleaning liquid and to clean the dirty liquid container. This considerably facilitates operation of the floor cleaning apparatus for a user, whether it is moved autonomously and/or guided manually.

It may be provided—a point discussed below—for the reservoir to be filled and the dirty liquid container rinsed one after the other. It is also conceivable for filling of the reservoir and rinsing of the dirty liquid container to be performed at the same time.

In a structurally simple embodiment, it is favorable if the docking station comprises a supply conduit with a connection element arranged thereon, and if the floor cleaning apparatus has a liquid conduit that branches into a first liquid conduit portion and a second liquid conduit portion. In an embodiment of this kind, only a single supply conduit may be sufficient for the docking station. When the floor cleaning apparatus is in the docked position, the supply conduit is coupled to the liquid conduit that branches into two conduit portions. The reservoir may be filled with the cleaning liquid by way of the first liquid conduit portion. The rinsing liquid may be applied to the dirty liquid container by way of the second liquid conduit portion. The rinsing device may be connected to the second liquid conduit portion or formed thereby.

Favorably, the floor cleaning apparatus has at least one valve, wherein:

- a valve is connected into at least one of the liquid conduit portions, and the liquid conduit portion is selectively openable or blockable using this valve;
- a respective valve is preferably connected into each of the two liquid conduit portions, and the respective liquid conduit portion is selectively openable or blockable using the valve; or
- the liquid conduit branches into the optio selectively nally openable or blockable liquid conduit portions at a valve.

Depending on the switching position of the at least one valve, it is possible to select which of the liquid conduit portions has liquid applied to it. For filling the cleaning container, the first liquid conduit portion may be acted upon. For rinsing the dirty liquid container, the second liquid conduit portion may be acted upon. It is conceivable for both liquid conduit portions to have liquid applied to them at the same time.

In an advantageous embodiment of a different kind, it is favorable if the docking station comprises two supply conduits each with a respective connection element, and the floor cleaning apparatus comprises two liquid conduits each with a respective connection element. When the floor cleaning apparatus is in the docked position, a respective supply conduit and a respective liquid conduit are fluidically connected to one another. The floor cleaning system may have a valve in each combination comprising a supply conduit and a liquid conduit, for selectively opening or blocking the combination comprising a supply conduit and a liquid conduit. In a floor cleaning system of this kind, when the floor cleaning apparatus is in the docked position two combinations each comprising a supply conduit and a liquid conduit are formed. The reservoir can be filled with the cleaning liquid via a first combination. The dirty liquid container can be rinsed with rinsing liquid via the second combination. At least one valve is connected into each combination, by way of which the respective combination is selectively openable or blockable.

Favorably, the floor cleaning system has a control device that is coupled to the valves or valve, wherein the valves or valve are/is actuatable by the control device. The control device may in particular control the time sequence of filling the reservoir and rinsing the dirty liquid container. Control in accordance with a predetermined filling schedule and/or rinsing schedule is conceivable. Filling the reservoir as necessary, depending on the cleaning liquid for filling or the remaining quantity of liquid in the reservoir and/or depending on the degree of soiling of the dirty liquid container, is in particular also conceivable.

As an alternative or in addition, it may be provided for the valves or valve to be actuatable manually by an operator.

Advantageously, filling of the reservoir and/or rinsing of the dirty liquid container once the floor cleaning apparatus is docked is performable automatically, controlled by the control device. For example, docking of the floor cleaning apparatus may be detected by the control device. Then, the reservoir may be filled and/or the dirty liquid container rinsed, in accordance with the predetermined filling schedule and/or rinsing schedule, and/or as necessary. As a result of the automatic filling or rinsing, it is not necessary for an operator to trigger the filling procedure or rinsing procedure. The floor cleaning system is user-friendly.

Favorably, the control device is arranged in the floor cleaning apparatus.

As an alternative, it may be provided for the control device to be positioned in the docking station.

In an advantageous implementation of the floor cleaning system, it is favorable if the valves or valve are/is controllable such that filling of the reservoir and rinsing of the dirty liquid container are performable one after the other. In particular if only one supply conduit is provided in the docking station and a branched liquid conduit is provided in the floor cleaning apparatus, this has proved advantageous, in order, for filling and rinsing, to provide as great a pressure and flow of liquid as possible.

Preferably, the valves or valve are/is controllable such that first the reservoir is fillable and then the dirty liquid container is rinseable. It may for example be provided for dirty liquid to be drained out of the dirty liquid container when the floor cleaning apparatus is in the docked position. The time required for this may be utilized for filling the reservoir. The dirty liquid container is favorably only rinsed and cleaned once the dirty liquid has been drained off.

It is advantageous if the valves or valve are/is controllable such that filling of the reservoir and/or rinsing of the dirty liquid container is performable in accordance with one of the following:

- filling with cleaning liquid and/or rinsing with rinsing liquid for a predeterminable period;
- filling with cleaning liquid and/or rinsing with rinsing liquid in a predeterminable quantity;
- filling with cleaning liquid to a predeterminable level that is determinable using a level sensor on the reservoir.

With each of the three above-mentioned embodiments, it is favorable to perform an automatic and automated filling of the reservoir and rinsing of the dirty liquid container, and to enhance user friendliness further.

Preferably, the floor cleaning apparatus has an outlet opening arranged on the dirty liquid container, and a valve on the outlet opening or on an outlet conduit connected thereto, and the outlet opening or outlet conduit is selectively blockable or, for emptying the dirty liquid container, openable by way of this valve. When the floor cleaning apparatus is in the docked position, dirty liquid can be allowed to drain out of the dirty liquid container by way of the outlet opening and the outlet conduit possibly connected thereto. The emptying procedure may be started or ended by the valve.

Preferably, the valve is controllable by a control device that is preferably arranged in the floor cleaning apparatus. The emptying procedure may be started for example automatically by the control device once the floor cleaning apparatus is docked. Ending of the emptying procedure may be after a predetermined period of time has elapsed, after a predetermined quantity of dirty liquid has drained out, or on detection of a predetermined minimum level of dirty liquid in the dirty liquid container.

It is favorable if the valves are controllable such that emptying of the dirty liquid container is performable during filling of the reservoir. The time required to empty the dirty liquid container may be utilized for filling the reservoir.

The valves are preferably controllable such that the dirty liquid container can be rinsed after emptying. In particular if only one supply conduit and a branching liquid conduit are provided, this allows the filling and rinsing procedure when the floor cleaning apparatus is in the docked position to be made as short as possible. The cleaning operation may be resumed again as soon as possible.

Advantageously, the docking station has a collection container for the dirty liquid, and the dirty liquid container is emptiable into the collection container through the outlet opening or outlet conduit.

It may be provided for the docking station to comprise a pumping unit by which dirty liquid in the collection container is pumpable away and suppliable to a liquid drainage network. Once the dirty liquid has been emptied into the collection container, or during emptying, the pumping unit can be activated and the dirty liquid pumped away. Preferably, the pumping unit is activatable by a control device of the floor cleaning apparatus.

Advantageously, the floor cleaning system comprises a detection device by which docking of the floor cleaning apparatus to the docking station is determinable. After a positive determination that the floor cleaning apparatus has docked to the docking station, it is possible for example for the above-mentioned control device to switch the valve or valves such that the reservoir is filled and/or the dirty liquid container is rinsed and in particular also emptied. The detection device may in particular take an electrical or mechanical form. For example, the fact that electrical connection elements of the docking station and the floor cleaning apparatus are in conductive connection with one another is detected in the control device of the floor cleaning apparatus.

It is favorable if the cleaning liquid and the rinsing liquid are identical, both preferably being water. Preferably, in this case on the input side of the supply conduit the docking station has only one connection element for connection to a liquid supply network and in particular to a water supply network. This allows separate supply conduits to be dispensed with.

In an advantageous implementation of the floor cleaning system, it is favorable if the rinsing device is arranged or fixed on a cover wall of the dirty liquid container. This makes it possible to rinse the dirty liquid container with the rinsing liquid from top to bottom and to remove contamination from the dirty liquid container effectively.

Advantageously, the dirty liquid container has a cover forming the cover wall. The cover may in particular be mounted pivotally on the floor cleaning apparatus such that it can be flipped open and closed. The cover may serve as a cover not only for the dirty liquid container but also for the reservoir.

It will be appreciated that an outlet opening of the dirty liquid container is preferably arranged at its lowest point.

Preferably, the rinsing device comprises a rinsing conduit having a plurality of outlet openings. Rinsing liquid can exit through the outlet openings. Favorably, the rinsing conduit is formed or comprised by a liquid conduit portion of the at least one liquid conduit, as already mentioned above.

In an advantageous embodiment of the floor cleaning system, the rinsing conduit is a ring conduit. The term "ring conduit" does not necessary presuppose a round and in particular circular form for the rinsing conduit. In the present case, the term "ring conduit" should be understood in particular as a "self-contained" rinsing conduit.

It is favorable if rinsing liquid exiting from the rinsing device is directed towards at least one side wall of the dirty liquid container. This makes it possible to rinse off the side wall and free it from particles. Advantageously, all the side walls are rinsed off from top to bottom.

It has proved advantageous if the floor cleaning apparatus comprises a supply conduit which has a connection element arranged thereon and opens into the at least one liquid conduit, and an outside supply conduit is connectable to the connection element manually, for supplying cleaning liquid and/or rinsing liquid. As a result, the floor cleaning system has more versatility. An operator can optionally connect a separate, outside supply conduit to the additional connection element. This makes it possible to fill the reservoir independently of the docking station and/or to rinse the dirty liquid container independently of the docking station.

As mentioned in the introduction, the floor cleaning apparatus may be formed to be self-propelling and self-steering in order to perform autonomous cleaning of the floor surface.

As an alternative or in addition, it may be provided for the floor cleaning apparatus to be guided manually. Here, the floor cleaning apparatus may be a ride-on apparatus or a walk-behind apparatus.

Depending on the mode of operation, it may be provided for the floor cleaning apparatus to be operated in self-propelling and self-steering manner or with manual guidance.

The floor cleaning apparatus is in particular a scrubber/vacuum cleaner.

The drawings show a preferred embodiment of a floor cleaning system in accordance with the invention that bears the reference numeral 10 and is designated the system 10 below for the sake of simplicity. The system 10 comprises a docking station 12 and a mobile floor cleaning apparatus 14, designated the apparatus 14 below for the sake of simplicity. The system 10 is positioned in a position of use on a set-down surface 16, which at the same time forms a floor surface 18 to be cleaned.

Indications of position and orientation such as "top", "bottom" or similar are to be understood in relation to the position of use of the system 10 on the set-down surface 16. In the position of use, the system 10 defines a plane of contact that coincides with the set-down surface 16. It may be assumed non-restrictively that the set-down surface 16 and the plane of contact are oriented to be horizontal.

The docking station 12 comprises a housing 20 that forms a receiving space 22 that receives various actuators, fluid conduits and electrical lines.

In particular, the docking station 12 is connected to a liquid supply network, in particular a water supply network, by a connection element 24. The connection element 24 is arranged at the end of a supply conduit 26, at the opposite end whereof a further connection element 28 is arranged. A valve 30, controllable for example by way of a control line 32, is connected into the supply conduit 26.

The docking station 12 is connectable to a power supply network by way of a connection element 34. The connection element 34 is arranged on an electrical line 36, at the other end whereof a connection element 38 is likewise arranged. The electrical line 36 may have a plurality of individual lines and is used for energy supply on the one hand and for the transmission of electrical switching and/or control signals on the other, for example by way of the control line 32, which branches off from the electrical line 36. It is also conceivable for the energy supply on the one hand and the electrical switching and/or control signals to be performed by way of separate lines.

From the electrical line 36 there branch off further control lines 40, 42 that are connected to electrical switching elements 44, 46 in the form of relays. The switching element 44 can be used to enable the electrical line 36 for enabling a charging current path from the connection element 34 to the connection element 38. The switching element 46 can be used to enable an electrical line 48 that branches off from the electrical line 36 and applies electrical energy to a pumping unit 50 of the docking station 12.

The docking station 12 comprises a collection container 52 for dirty liquid of the apparatus 14. A supply conduit 54 of the docking station 12, on the input side whereof a connection element 56 is arranged, opens into the collection container 52. A drainage conduit 58 is connected to the output side of the collection container 52 with a connection element 60 at its end. The pumping unit is connected into the drainage conduit 58 in order to pump dirty liquid away out of the collection container 52 and to supply it to a liquid drainage network via the connection element 60.

Arranged on the collection container 52 is a sensor element 62 by which a level of dirty liquid in the collection container 52 is determinable. A level signal relating to this may be provided by way of a signal line 64.

Further, a control line 66 branches off from the electrical line 36 and a drive device 68, which is discussed below, is controllable by way of the control line 66.

The apparatus 14 comprises a housing 70 having a travelling gear 72 held on the underside thereof, for rolling on the floor surface 18. The apparatus 14, a scrubber/vacuum cleaner, further comprises a cleaning unit 74 that has in particular at least one roller-shaped or plate-shaped cleaning tool (not shown) that is drivable in rotation about an axis of rotation. A further cleaning unit in the form of a dirt receiving device 76 is provided. The dirt receiving device 76 comprises a suction bar 78 and a suction unit 80, in order to apply negative pressure to the suction bar 78 (not illustrated in FIG. 3).

Further, the apparatus 14 comprises a reservoir 82 for a cleaning liquid, in particular water. The apparatus 14 further comprises a dirty liquid container 84. When the apparatus 14 is in operation, cleaning liquid from the reservoir 82 can be used for application to the floor surface 18. Under the action of the cleaning unit 74, the floor surface 18 can be cleaned, wherein the cleaning liquid serves to enhance the cleaning action. As a supplementary measure, a chemical cleaning agent may be added. The mixture of dirt and cleaning liquid—the dirty liquid—can be taken up from the floor surface 18 by the dirt receiving device 76 and deposited in the dirty liquid container 84 as dirty liquid.

Figure 3:
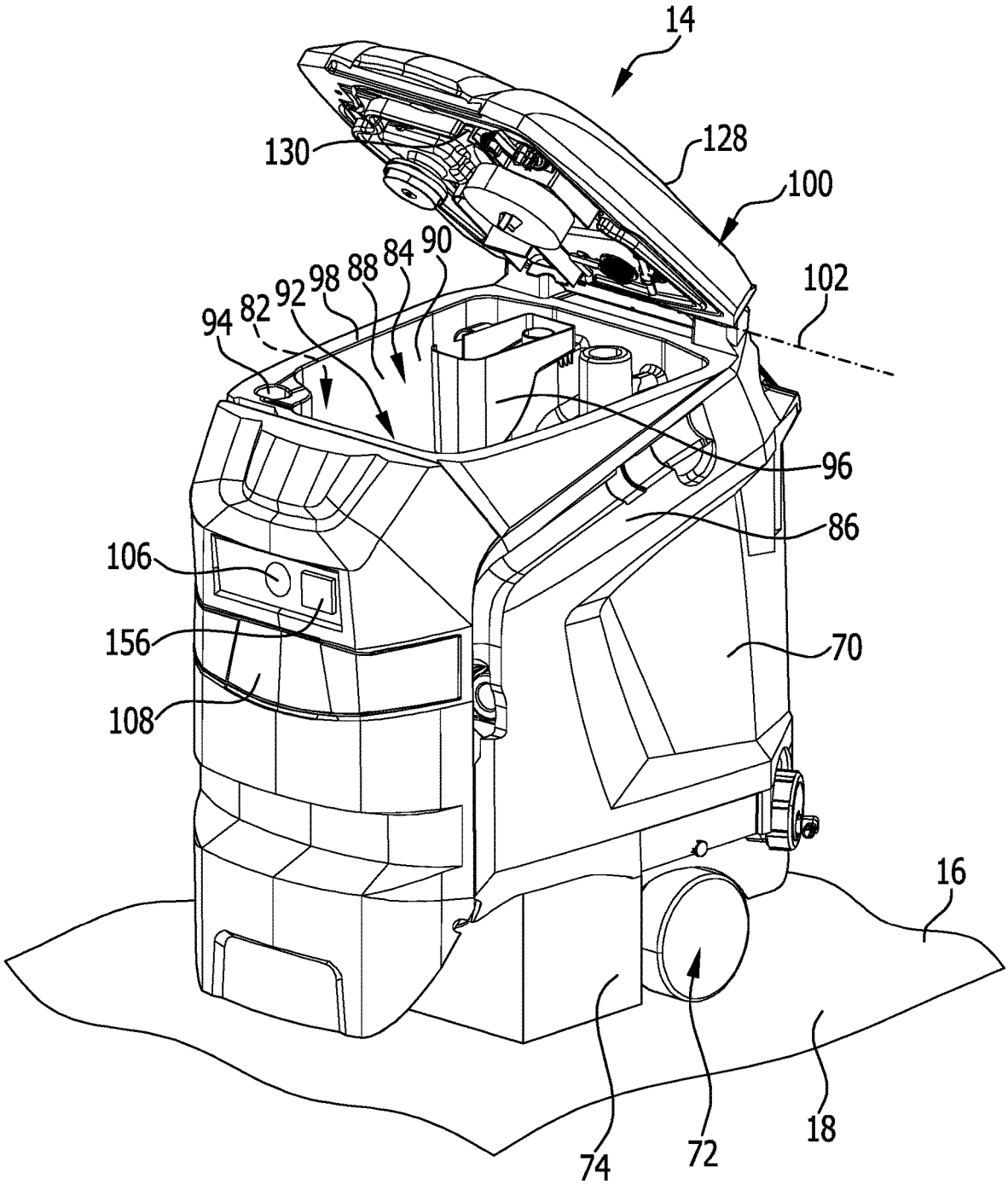
FIG. 3 shows a simplified perspective illustration of the floor cleaning apparatus, having a cover for two containers, which is in an open position.

In the apparatus 14, the reservoir 82 and the dirty liquid container 84 are formed in accordance with an advantageous container-in-container concept. The reservoir 82 surrounds the dirty liquid container 84 and is laterally delimited by an outer wall 86 and an inner wall 88 of the housing 70, and by a base wall (not illustrated in the drawing). The inner wall 88 forms side walls 90 of the dirty liquid container 84. The side walls 90 and a base wall (not shown in the drawing) define a container interior 92 (FIG. 3).

Arranged at the upper side of the reservoir 82 is a container opening 94 and at the upper side of the dirty liquid container 84 is a container opening 96. A rim 98 that runs around the outside of the housing 70 encloses the container openings 94 and 96.

The apparatus 14 comprises, as a constituent part of the housing 70, a cover 100 that forms a respective cover wall of the reservoir 82 and the dirty liquid container 84. In the present case, the cover 100 is pivotal on the rest of the housing 70, and can be flipped open and closed, about a pivot axis 102.

For applying liquid to the reservoir 82 and the dirty liquid container 84, the apparatus 14 comprises a liquid conduit 104 with a connection element 106. The connection element 106 is arranged on a front side 108 of the apparatus 14, facing the docking station 12 in a docked position.

The term "front side" relates to a direction of longitudinal or principal movement of the apparatus 14.

The liquid conduit 104 is guided through the housing 70 and enters the cover 100 at a joint for mounting the cover 100. It branches off into a first liquid conduit portion 110 and a second liquid conduit portion 112. A respective valve 114, 116 is connected into the liquid conduit portions 110, 112 and can be used selectively to open or close the liquid conduit 104 at the respective portion 110, 112. The valves 114, 116 are controllable by way of control lines 118, 120 by a control device 122 of the system 10. In the present case, the control device 122 is arranged in the apparatus 14.

In the present case, the liquid conduit 104 is branched into the liquid conduit portions 110, 112 in a valve housing 124 that receives the valves 114, 116. The valve housing 124 is received in a receiving space 126 that is formed between an outer wall 128 and an inner wall 130 of the cover 100, which in the present case takes a double-walled form.

At the inner wall 130, the first liquid conduit portion 110 has an outlet opening 132 at its end. When there is a flow connection through the liquid conduit portion 110, the liquid conduit 104 forms a filling conduit for filling the reservoir 82. The cleaning liquid can exit by way of the outlet opening 132 and flow through the container opening 94 and into the interior of the reservoir 82.

A sensor element 134 on the reservoir 82 is coupled by way of a signal line 136 to the control device 122 in order to transmit thereto information on the level of cleaning liquid in the reservoir 82.

The second liquid conduit portion 112 exits from the receiving space 126 and forms a ring conduit 138. The ring conduit 138 is fixed to the underside of the inner wall 130 and comprises a plurality of outlet openings (not illustrated individually). The ring conduit 138 is a rinsing conduit of a rinsing device 140 for rinsing the dirty liquid container 84. By way of the position of outlet openings on the ring conduit 138, rinsing liquid is directed onto the side walls 90 of the dirty liquid container 84 such that they can be rinsed off from top to bottom and particles adhering thereto can be loosened.

Arranged on the dirty liquid container 84 is a sensor element 142 that is coupled to the control device 122 by way of a signal line 144 in order to provide the control device 122 with a signal of the level in the dirty liquid container 84.

Further, arranged in the dirty liquid container 84 there is an outlet opening 146 to which an outlet conduit 148 is connected. The outlet conduit 148 has a connection element 150 at its end. Connected into the outlet conduit 148 is a valve 152 on which it is possible for the drive device 68 to operate when the apparatus 14 is in a docked position (discussed below).

Further, the apparatus 14 comprises an electrical line 154 with, arranged thereon, a connection element 156 that can be coupled to the connection element 38 of the conduit 36. It is possible for example to charge at least one battery 158 of the apparatus 14 by way of the electrical line 154.

Operation of the system 10 is discussed below.

The apparatus 14 may be a self-propelling and self-steering floor cleaning apparatus (a floor cleaning robot) by which the floor surface 18 may be cleaned autonomously. The control device 122 can control the movements of the apparatus 14, by control of a drive for the travelling gear 72 and also the cleaning units.

Figure 2:
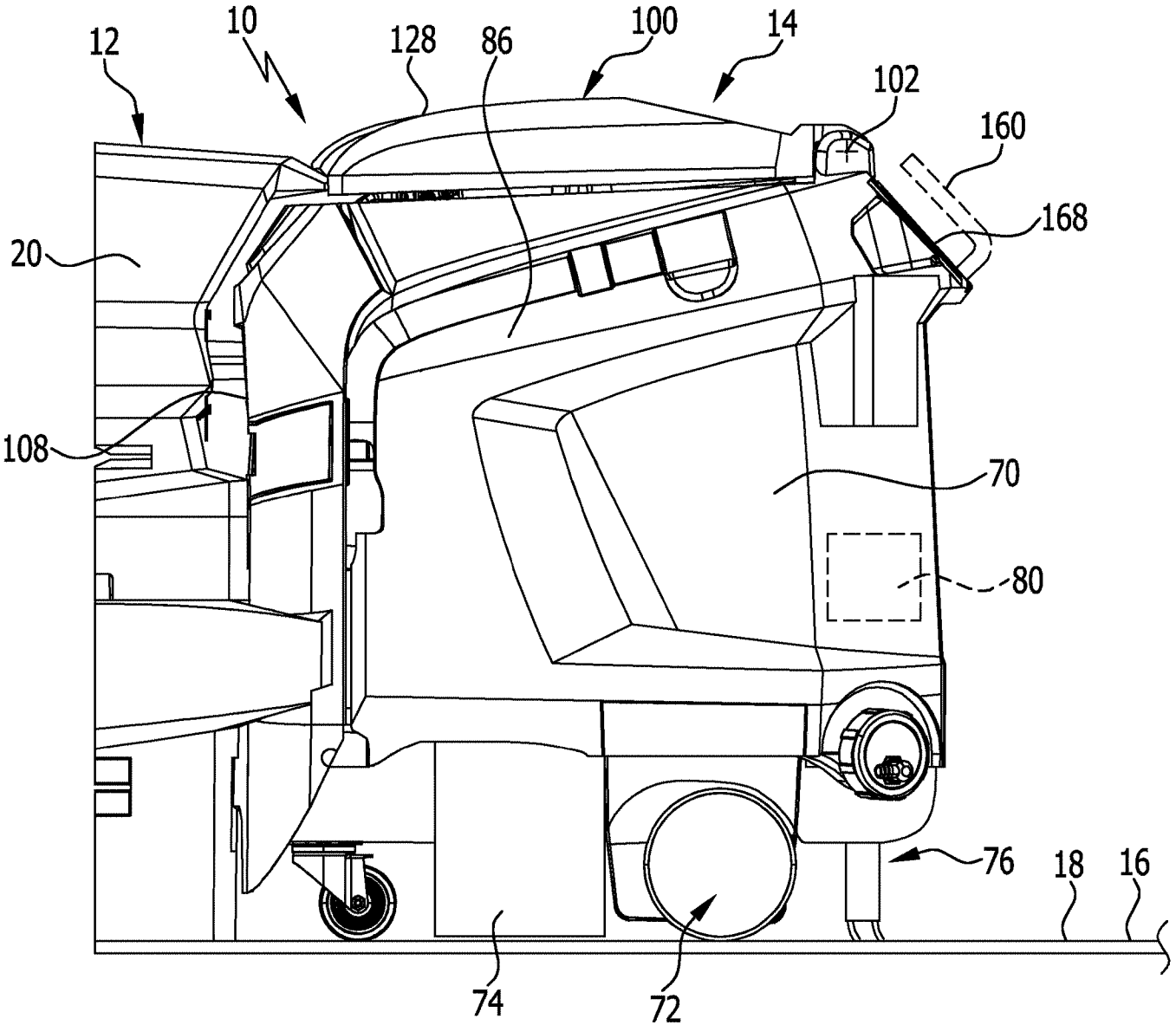
FIG. 2 shows the floor cleaning system from FIG. 1, wherein the floor cleaning apparatus is in a docked position.

As an alternative or in addition, it may be provided for the apparatus 14 to be guided manually, and to be guided over the floor surface 18 by an operator. A drive for the travelling gear 72 may be provided. The operator may operate the apparatus 14 by way of a handle 160, which is illustrated schematically and comprises in particular a gripping device (FIGS. 1 and 2).

When the apparatus 14 is in operation, cleaning liquid from the reservoir 82 is used for application to the floor surface 18, as mentioned. The dirty liquid is transferred to the dirty liquid container 84. For this reason, the liquid level in the reservoir 82 falls when the apparatus 14 is in operation, and the level in the dirty liquid container 84 rises.

For filling the reservoir 82 and for rinsing and emptying the dirty liquid container 84, the apparatus 14 can be docked to the docking station 12. Here, automatically or guided by the operator, the apparatus is moved out of a non-docked position (FIG. 1) into a docked position (FIG. 2). In the docked position, the connection elements 28 and 106, 38 and 156, and 56 and 150 are coupled to one another.

If, instead of the line 36, separate lines are used for the energy supply and for the switching and/or control signals, then different individual lines may likewise be provided instead of the line 154; instead of the two connection elements 38, 156, separate connection elements may be provided for the energy supply on the one hand and the transmission of switching and/or control signals on the other.

The apparatus 14 has a detection device 162 in order to detect the fact that the apparatus 14 has docked to the docking station 12. In the present case, the detection device 162 is formed by, or comprises, among other things the control device 122. For example, utilizing electrical energy from the battery 158, the control device 122 can detect a current flow through one of the switching elements 44, 46 when the apparatus 14 adopts the docked position and the connection elements 38, 156 are coupled to one another. It may also be provided for an electrical contact bridge to be formed by way of the docking station 12 when the apparatus 14 adopts the docked position. A current flow through the docking station 12 that is produced by the contact bridge can be detected by the control device 122.

When adoption of the docked position is detected by the control device 122, the reservoir 82 and the dirty liquid container 84 may be filled, emptied and rinsed for example as explained below. In particular, the filling procedure, the emptying procedure and the rinsing procedure may be triggered automatically by the control device 122 and thus as it were without intervention by an operator.

After docking, the control device 122 may actuate the valve 30 by way of the control line 32 for opening the fluid connection through the supply conduit 26 and the liquid conduit 104. The connection elements 28, 106 may comprise self-opening (and self-blocking) valves that automatically open when the apparatus 14 is docked and automatically close when it is undocked.

First of all, preferably the valve 114 is actuated by the control device 122 by way of the control line 118 such that the liquid conduit portion 110 is opened. By contrast, the liquid conduit portion 112 is blocked by the valve 116. The reservoir 82 is filled by way of the supply conduit 26 and the liquid conduit 104, in particular the liquid conduit portion 110 thereof. The filling procedure may be performed for a predeterminable period, until a predeterminable quantity of cleaning liquid has been put in, or until a liquid level in the reservoir 82 that is detectable using the sensor element 134 is determined.

Further, dirty liquid may be drained out of the dirty liquid container 84. For this purpose, the control device 122 may activate the drive device 68 by way of the control line 66. This actuates the valve 152, and there is a fluid connection from the dirty liquid container 84 through the outlet conduit 148, the connection elements 56, 150 and the supply conduit 54 and into the collection container 52. Preferably, the dirty liquid container 84 is emptied while the reservoir 82 is being filled. This allows the dwell time of the apparatus 14 at the docking station 12 to be kept as short as possible.

The control device 122 may further activate the pumping unit 50 in that the switching element 46 is switched, for opening the line 48, by way of the control line 42. When the pumping unit 50 is activated, dirty liquid can be pumped out of the collection container 52 and supplied to the liquid drainage network. Here, it is possible for the pumping unit 50 already to be activated when the dirty liquid container 84 is emptied, or to be activated only once a predetermined liquid level is reached in the collection container 52, wherein the level can be detected by the sensor element 62. Also conceivable is regular activation of the pumping unit 50.

Once the dirty liquid container 84 has been emptied, the control device 122 can actuate the drive device 68 again such that the valve 152 blocks the outlet conduit 148.

The dirty liquid container 84 is then rinsed and cleaned. Here, it is advantageous if the control device 122 actuate the valve 116 for opening the liquid conduit portion 112. Favorably, during the rinsing procedure the liquid conduit portion 110 is blocked by the valve 114 so that a liquid pressure as high as possible can be applied to the rinsing device 140. The rinsing liquid exits from the rinsing device 140 and rinses the side walls 90 from top to bottom.

Then, the control device can actuate the valve 30 by way of the control line 32, for blocking the supply conduit. The valves 114, 116 may likewise be actuated for blocking the liquid conduit portions 110, 112.

Any rinsing liquid in the dirty liquid container 84 can be removed from the dirty liquid container 84, by a renewed actuation of the valve 152 by the drive device 68, and transferred to the collection container 52.

As an alternative, it is also conceivable, in a manner differing from the explanation above, for the valve 152 to be actuated for opening the outlet conduit 148 during rinsing of the dirty liquid container 84. Rinsing liquid may flow into the collection container 52 after cleaning of the dirty liquid container 84.

When the apparatus 14 is docked, it is further possible for the at least one electric battery 158 to be charged by way of the lines 36, 154.

Figure 4:
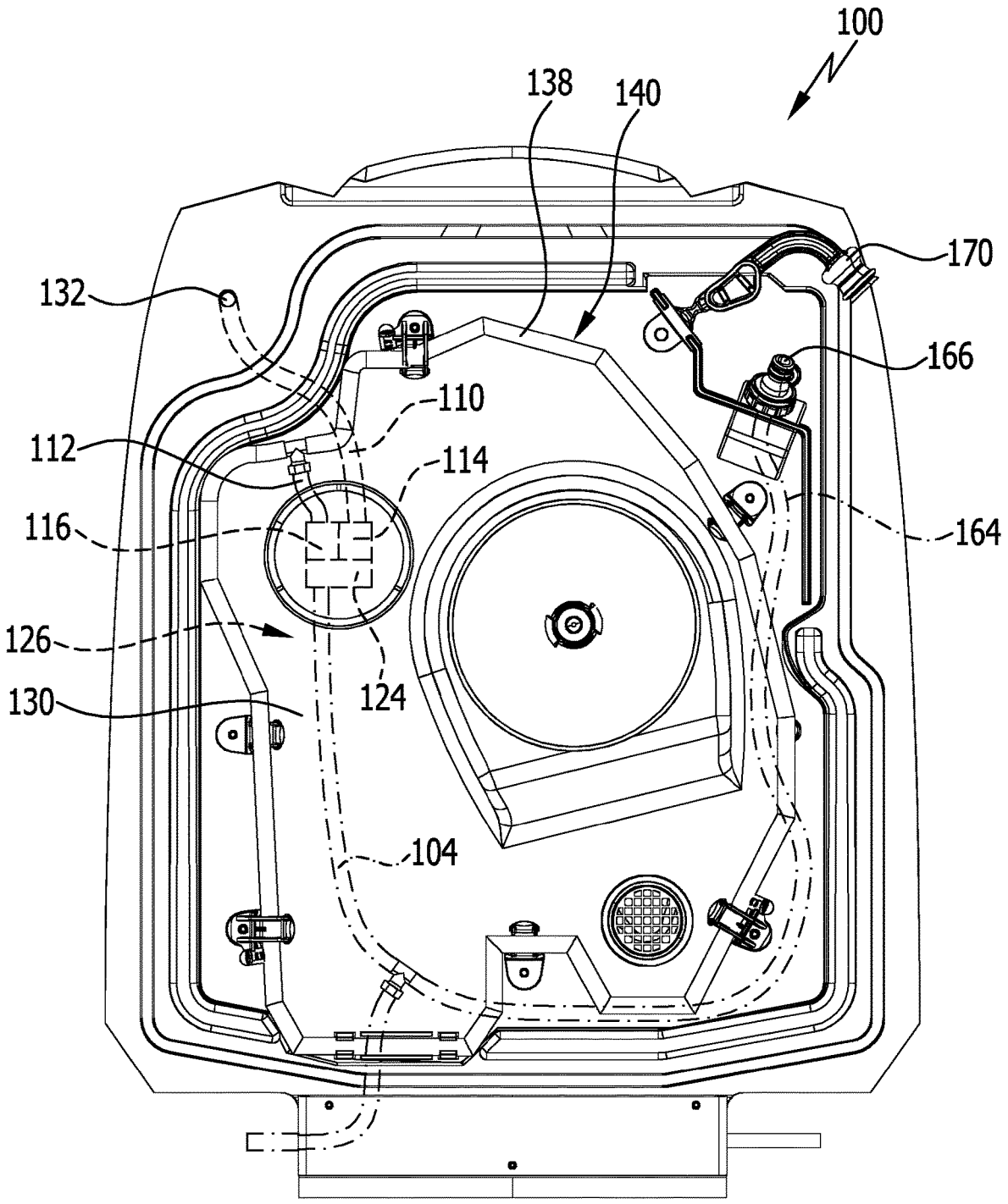
FIG. 4 shows a partly schematic view from below of the cover of the floor cleaning apparatus from FIG. 3.
Figure 5:
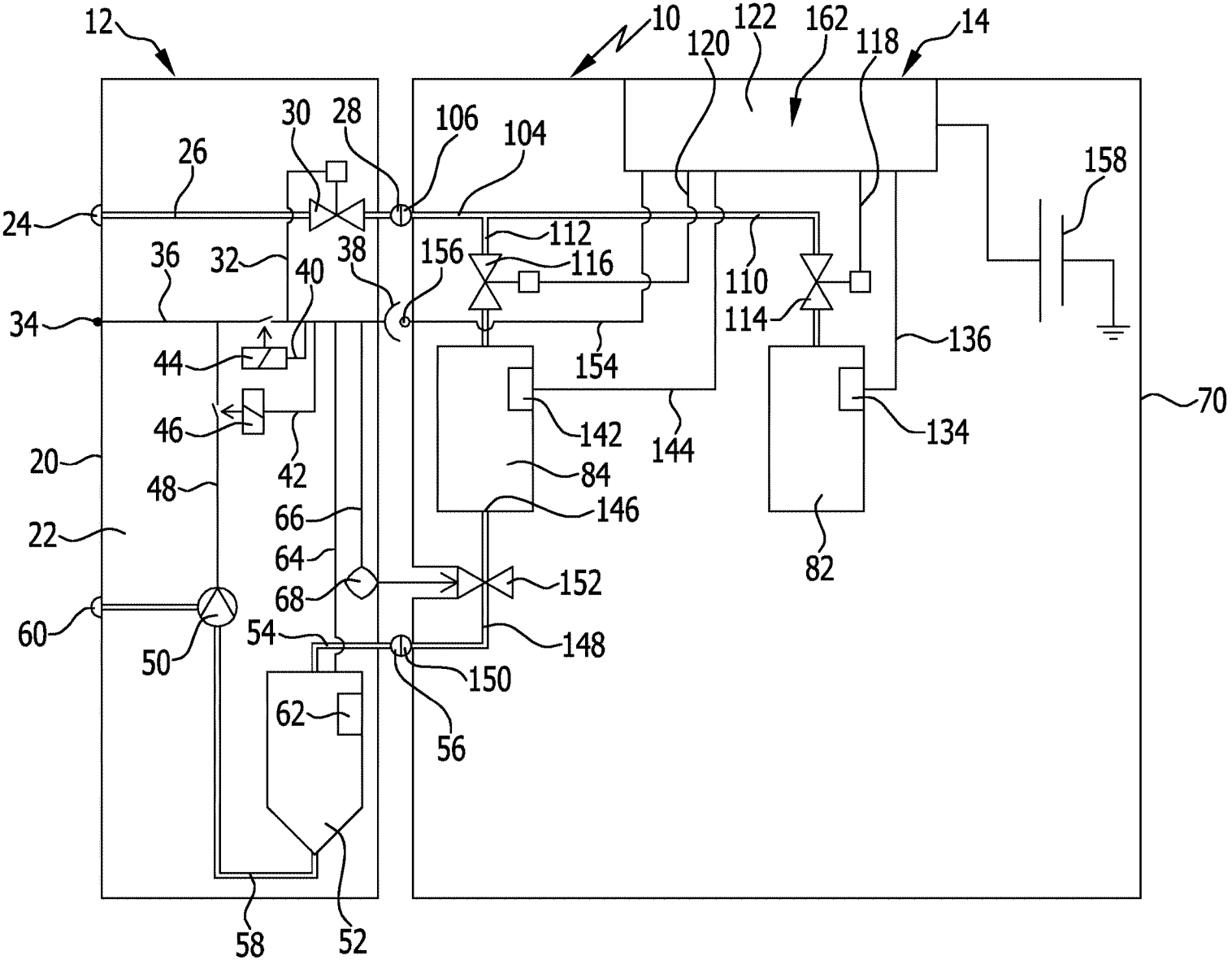
FIG. 5 shows the floor cleaning system from FIG. 1, partly illustrated by a schematic block circuit diagram.

As is clear in particular from FIG. 4, the apparatus 14 comprises a supply conduit 164 in the cover 100. The supply conduit 164 opens into the liquid conduit 104, in the receiving space 126 and upstream of the valve housing 124. Arranged on the end of the supply conduit 164 is a connection element 166 that, in the present case, takes the form of a hose nipple.

An outside supply conduit (not shown in the drawings) may be connected to the connection element 166 by an operator in order to apply liquid, in particular water, to the supply conduit 164. The liquid flows into the valve housing 124 and from there selectively into one of the liquid conduit portions 110, 112 for filling the reservoir 82 and/or rinsing the dirty liquid container 84. It is conceivable for the operator to be able to predetermine which valve 114, 116 opens or blocks the respective liquid conduit portion 110, 112, by way of an operating device 168 of the apparatus 14.

A self-blocking valve that is arranged in the connection element 106 ensures that if the outside supply conduit is connected when the apparatus 14 is undocked no liquid exits from the liquid conduit 104.

In addition to the possibility of filling the reservoir 82 and rinsing the dirty liquid container 84 respectively using the arrangements of the docking station 12, this allows a filling or rinsing procedure of this kind to be performed if the outside supply conduit is connected to the supply conduit 164.

It is likewise possible to provide a self-blocking valve and/or a closing-off element 170 at the connection element 166, such that when fluid is applied to the liquid conduit 104 through the docking station 12 no liquid exits through the supply conduit 164. FIG. 4 shows the closing-off element 170 in a condition detached from the connection element 166.

The arrangement of the connection element 166 and the course of the supply conduit 164 may also be different. For example, the connection element 166 is positioned such that it is accessible to an operator without opening the cover 100.

REFERENCE NUMERALS

10 Floor cleaning system
12 Docking station
14 Floor cleaning apparatus
16 Set-down surface
18 Floor surface
20 Housing
22 Receiving space
24 Connection element
26 Supply conduit
28 Connection element
30 Valve
32 Control line
34 Connection element
36 Electrical line
38 Connection element
40 Control line
42 Control line
44 Switching element
46 Switching element
48 Electrical line
50 Pumping unit
52 Collection container
54 Supply conduit
56 Connection element
58 Drainage conduit
60 Connection element
62 Sensor element
64 Signal line
66 Control line
68 Drive device
70 Housing
72 Travelling gear
74 Cleaning unit
76 Dirt receiving device
78 Suction bar
80 Suction unit
82 Reservoir
84 Dirty liquid container
86 Outer wall
88 Inner wall
90 Side wall
92 Container interior
94 Container opening
96 Container opening
98 Rim
100 Cover
102 Pivot axis
104 Liquid conduit
106 Connection element
108 Front side
110 Liquid conduit portion
112 Liquid conduit portion
114 Valve
116 Valve
118 Control line
120 Control line
122 Control device
124 Valve housing
126 Receiving space
128 Outer wall
130 Inner wall
132 Outlet opening
134 Sensor element
136 Signal line
138 Ring conduit
140 Rinsing device
142 Sensor element
144 Signal line
146 Outlet opening
148 Outlet conduit
150 Connection element
152 Valve
154 Electrical line
156 Connection element
158 Battery
160 Handle
162 Detection device
164 Supply conduit
166 Connection element
168 Operating device
170 Closing-off element

What is claimed is:

1. A floor cleaning system, having a mobile floor cleaning apparatus that comprises at least one cleaning unit for cleaning a floor surface, a reservoir for receiving a cleaning liquid, a dirt receiving device for taking up dirty liquid from the floor surface, and a dirty liquid container into which the dirty liquid is transferable, and further having a docking station for the floor cleaning apparatus, which is docked thereto in a docked position, wherein the docking station has at least one supply conduit with a connection element arranged thereon, the floor cleaning apparatus having at least one liquid conduit with a connection element arranged thereon, wherein the floor cleaning apparatus comprises a rinsing device on or in the dirty liquid container, and wherein, when the floor cleaning apparatus is in the docked position, the connection elements are coupled to one another such that the reservoir is fillable with the cleaning liquid via the at least one liquid conduit and a rinsing liquid for rinsing the dirty liquid container is applicable to the rinsing device via the at least one liquid conduit.

2. A floor cleaning system in accordance with claim 1, wherein the docking station comprises one supply conduit with a connection element arranged thereon, and wherein the floor cleaning apparatus has a liquid conduit that branches into a first liquid conduit portion and a second liquid conduit portion.

3. A floor cleaning system in accordance with claim 2, wherein the floor cleaning apparatus has at least one valve, wherein:

the at least one valve is connected into at least one of the liquid conduit portions, and the liquid conduit portion is selectively openable or blockable using this valve;

a respective one of the at least one valve is connected into each of the two liquid conduit portions, and the respective liquid conduit portion is selectively openable or blockable using the valve; or the liquid conduit branches into the selectively openable or blockable liquid conduit portions at the at least one valve.

4. A floor cleaning system in accordance with claim 1, wherein the docking station comprises two supply conduits each with a respective connection element, and the floor cleaning apparatus comprises two liquid conduits each with a respective connection element, wherein, when the floor cleaning apparatus is in the docked position, a respective supply conduit and a respective liquid conduit are fluidically connected to one another, and wherein the floor cleaning system has a valve in each combination comprising a supply conduit and a liquid conduit, for selectively opening or blocking the combination comprising a supply conduit and a liquid conduit.

5. A floor cleaning system in accordance with claim 1, wherein the floor cleaning system has a control device that is coupled to at least one valve connected into the at least one liquid conduit or into at least one liquid conduit portion thereof, and wherein the valve is actuatable by the control device.

6. A floor cleaning system in accordance with claim 5, wherein at least one of filling of the reservoir and rinsing of the dirty liquid container once the floor cleaning apparatus is docked is performable automatically, controlled by the control device.

7. A floor cleaning system in accordance with claim 5, wherein the control device is arranged in the floor cleaning apparatus.

8. A floor cleaning system in accordance with claim 5, wherein the at least one valve is controllable such that filling of the reservoir and rinsing of the dirty liquid container are performable one after the other.

9. A floor cleaning system in accordance with claim 8, wherein the at least one valve is controllable such that first the reservoir is fillable and then the dirty liquid container is rinsable.

10. A floor cleaning system in accordance with claim 5, wherein the at least one valve is controllable such that at least one of filling of the reservoir and rinsing of the dirty liquid container is performable in accordance with one of the following:

filling with cleaning liquid and/or rinsing with rinsing liquid for a predeterminable period;

filling with cleaning liquid and/or rinsing with rinsing liquid in a predeterminable quantity;

filling with cleaning liquid to a predeterminable level that is determinable using a level sensor on the reservoir.

11. A floor cleaning system in accordance with claim 1, wherein the floor cleaning apparatus has an outlet opening arranged on the dirty liquid container, and a valve on the outlet opening or on an outlet conduit connected thereto, and the outlet opening or outlet conduit is selectively blockable or, for emptying the dirty liquid container, openable by way of this valve.

12. A floor cleaning system in accordance with claim 11, wherein the valve is controllable by a control device.

13. A floor cleaning system in accordance with claim 11, wherein the valve is controllable such that emptying of the dirty liquid container is performable during filling of the reservoir.

14. A floor cleaning system in accordance with claim 11, wherein the valve is controllable such that rinsing of the dirty liquid container is performable after emptying of the dirty liquid container.

15. A floor cleaning system in accordance with claim 11, wherein the docking station has a collection container for the dirty liquid, and wherein the dirty liquid container is emptiable into the collection container through the outlet opening or outlet conduit.

16. A floor cleaning system in accordance with claim 15, wherein the docking station comprises a pumping unit by which dirty liquid in the collection container is pumpable away and suppliable to a liquid drainage network.

17. A floor cleaning system in accordance with claim 1, wherein the floor cleaning system comprises a detection device by which docking of the floor cleaning apparatus to the docking station is determinable.

18. A floor cleaning system in accordance with claim 1, wherein the cleaning liquid and the rinsing liquid are identical, and wherein on the input side of the supply conduit the docking station has only one connection element for connection to a liquid supply network.

19. A floor cleaning system in accordance with claim 1, wherein the rinsing device is arranged or fixed on a cover wall of the dirty liquid container.

20. A floor cleaning system in accordance with claim 19, wherein the dirty liquid container has a cover forming the cover wall.

21. A floor cleaning system in accordance with claim 1, wherein the rinsing device comprises a rinsing conduit having a plurality of outlet openings.

22. A floor cleaning system in accordance with claim 21, wherein the rinsing conduit is formed or comprised by a liquid conduit portion of the at least one liquid conduit.

23. A floor cleaning system in accordance with claim 21, wherein the rinsing conduit is a ring conduit.

24. A floor cleaning system in accordance with claim 1, wherein rinsing liquid exiting from the rinsing device is directed towards at least one side wall of the dirty liquid container.

25. A floor cleaning system in accordance with claim 1, wherein the floor cleaning apparatus comprises a supply conduit which has a connection element arranged thereon and opens into the at least one liquid conduit, and an outside supply conduit is connectable to the connection element manually, for supplying at least one of cleaning liquid and rinsing liquid.

26. A floor cleaning system in accordance with claim 1, wherein the floor cleaning apparatus is formed to be self-propelling and self-steering.

27. A floor cleaning system in accordance with claim 1, wherein the floor cleaning apparatus is guided manually.

* * * * *